United States Patent [19]

Tieben

[11] Patent Number: 4,699,713

[45] Date of Patent: Oct. 13, 1987

[54] SEED CLEANER

[76] Inventor: James B. Tieben, Rte. 1, W. McArtor Rd., Box 394, Dodge City, Kans. 67801

[21] Appl. No.: 837,427

[22] Filed: Mar. 7, 1986

[51] Int. Cl.[4] ..... B07B 1/28; B07B 1/42

[52] U.S. Cl. ..... 209/315; 209/366; 209/370; 209/413; 209/420

[58] Field of Search ..... 209/311, 315, 365 R, 209/365 C, 366, 413, 412, 414, 317, 319, 260, 404, 409, 420, 363, 364, 370, 372

[56] References Cited

U.S. PATENT DOCUMENTS

| | | | |
|---|---|---|---|
| 117,736 | 8/1871 | Bryan | 209/311 |
| 495,945 | 4/1893 | McDonough | 209/315 |
| 1,567,553 | 12/1925 | Stebbins | 209/365.4 |
| 1,713,143 | 5/1929 | Overstrom | 209/319 |
| 2,058,959 | 10/1936 | Denning | 209/315 |
| 2,706,046 | 4/1955 | Andrews | 209/420 |
| 3,722,673 | 3/1973 | Bedwell et al. | 209/692 |

FOREIGN PATENT DOCUMENTS

| | | | |
|---|---|---|---|
| 913125 | 7/1949 | Fed. Rep. of Germany | 209/366 |
| 2022766 | 12/1979 | United Kingdom | 209/315 |

*Primary Examiner*—Robert B. Reeves
*Assistant Examiner*—Donald T. Hajec
*Attorney, Agent, or Firm*—Willian Brinks Olds Hofer Gilson & Lione Ltd.

[57] ABSTRACT

A seed cleaning device includes a frame and first and second screened grids, each of which is pivotably mounted to the frame. Two crankshafts are mounted to the frame and are coupled to one another to remain 180 degrees out of phase with respect to one another. Each of the crankshafts causes a respective one of the screened grids to oscillate, such that the oscillation of the first screened grid is out of phase with the oscillation of the second screened grid.

3 Claims, 5 Drawing Figures

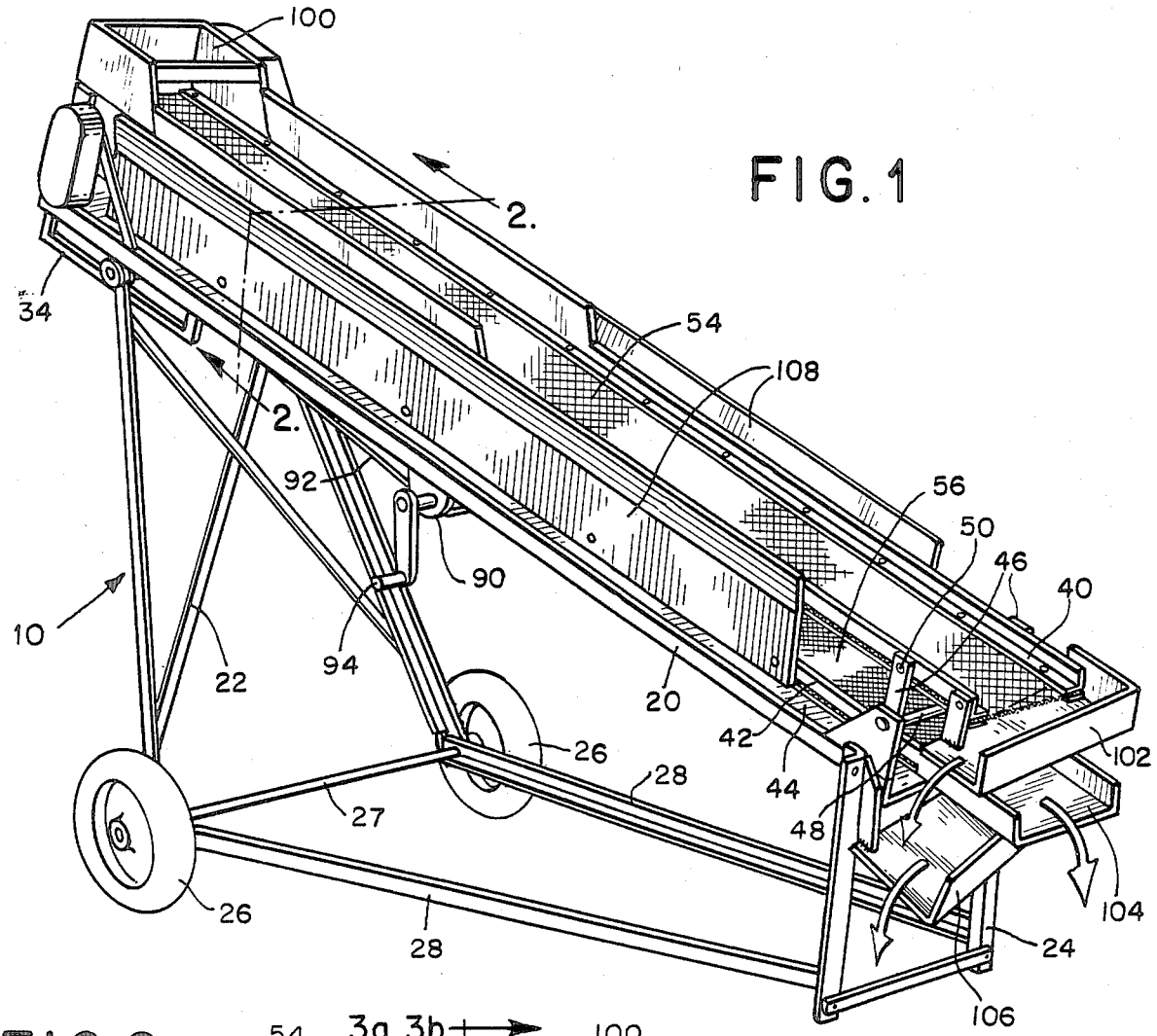
FIG. 1
FIG. 2
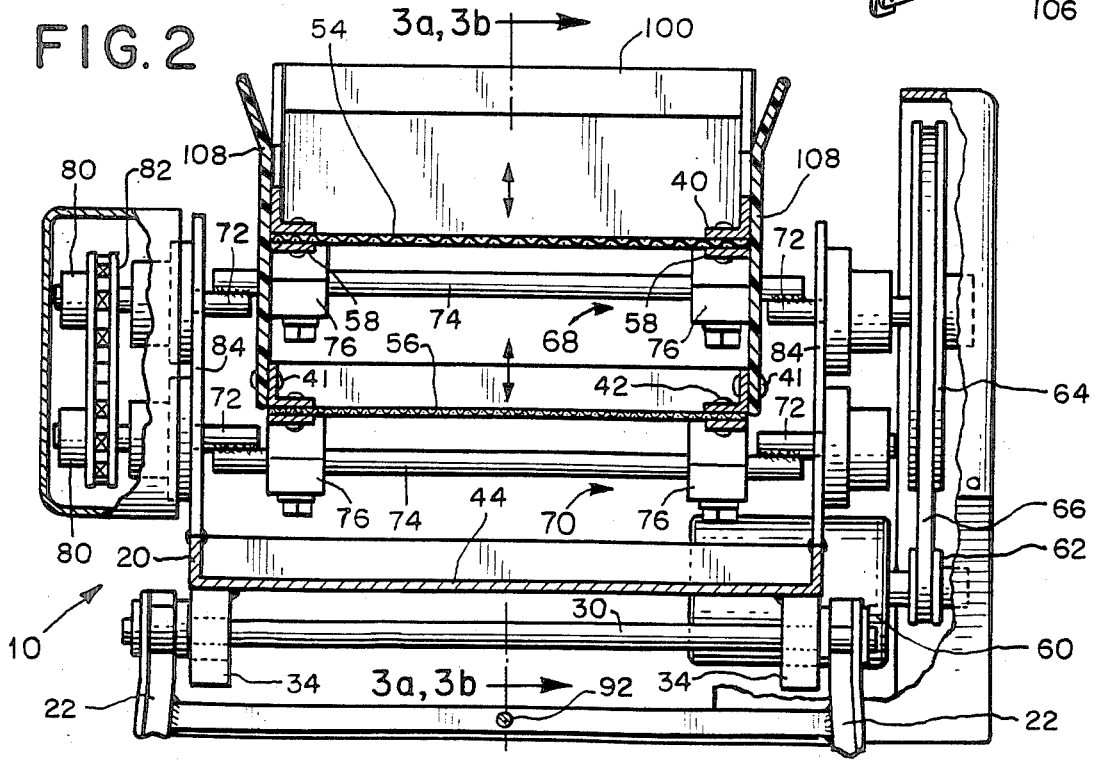

SEED CLEANER

BACKGROUND OF THE INVENTION

The present invention is directed to a simple and economical seed cleaner that can be used to separate seed from contaminants.

In the processing of seed it is often necessary to remove extraneous material from the seed, such as stalks and the like which are larger than the seed and cracked seeds, chaff, and the like which are smaller than the seed. Seed cleaners are commercially available to accomplish this task through the use of successive screened grids. However, commercially available seed cleaners are relatively complex and expensive devices. The present invention is directed to an improved seed cleaner which is remarkably simple and inexpensive in manufacture and use.

SUMMARY OF THE INVENTION

According to this invention a seed cleaning device is provided which comprises a frame and two screened grids. A first, relatively coarse screened grid and a second, relatively fine screened grid are each pivotably mounted to the frame about respective pivot axes such that the second screened grid is positioned to receive material which has passed through the first screened grid. A driven shaft is mounted to the frame and means are provided for coupling the driven shaft to the screened grids to oscillate each of the the screened grids about the respective pivot axis such that the oscillation of the first screened grid is out of phase with the oscillation of the second screened grid.

As will be apparent from the detailed description which follows, the preferred embodiment of this invention is relatively lightweight and inexpensive in construction. Because the first and second screened grids are oscillated out of phase with one another, overall oscillation of the seed cleaning device is minimized, as is the power required to oscillate the screened grids.

The invention itself, together with further objects and attendant advantages, will best be understood by reference to the following detailed description, taken in conjunction with the accompanying drawings.

BRIEF DESCRIPTION OF THE DRAWINGS

FIG. 1 is a perspective view of a presently preferred embodiment of the seed cleaner of this invention.

FIG. 2 is a cross-sectional view taken along line 2—2 of FIG. 1.

DETAILED DESCRIPTION OF THE PRESENTLY PREFERRED EMBODIMENT

Figure 3A:
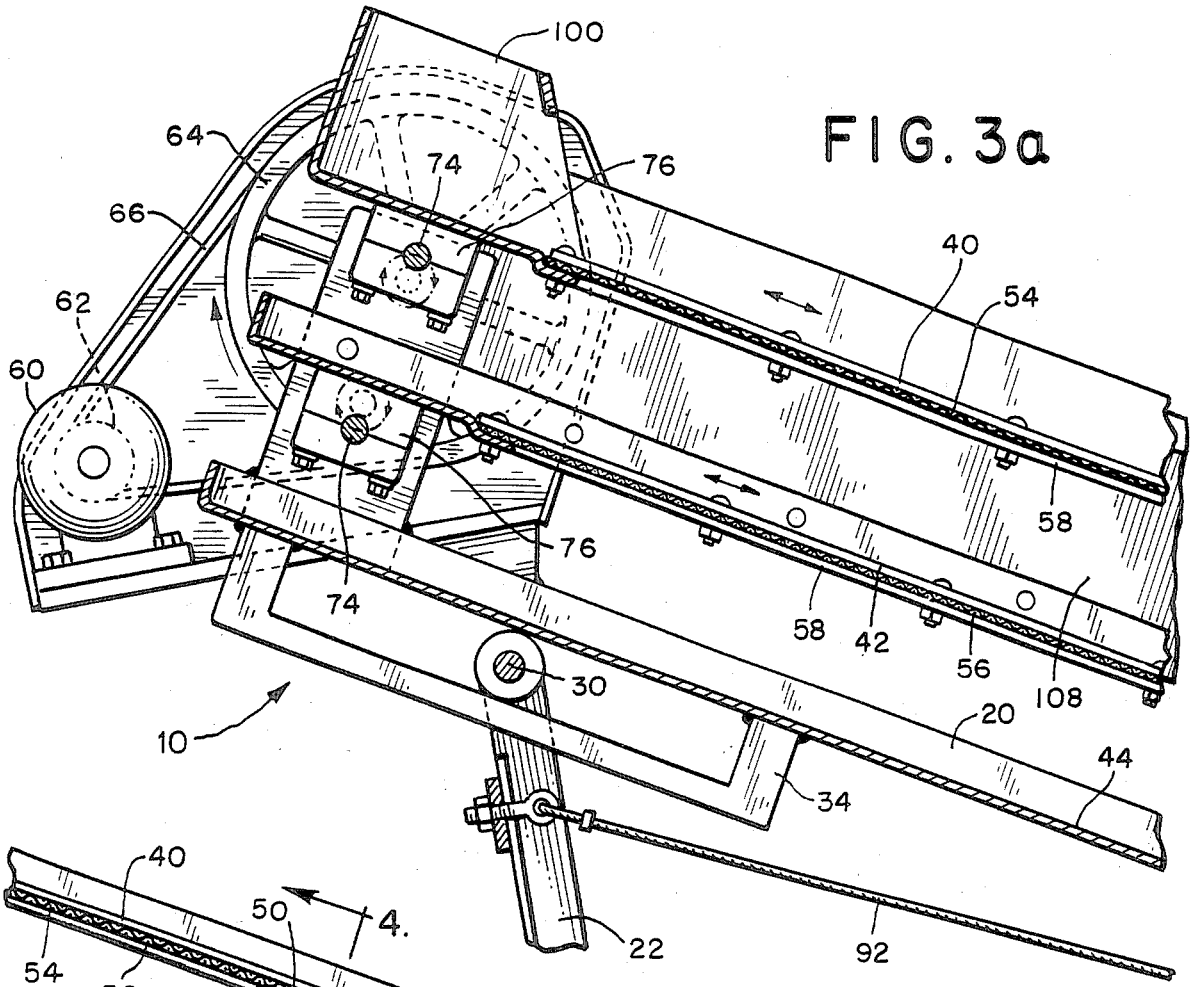
FIG. 3*a* is a longitudinal sectional view of the upper end of the embodiment of FIG. 1, taken along line 3*a*—3*a* of FIG. 2.

Turning now to the drawings, FIG. 1 shows a perspective view of a seed cleaner 10 which incorporates a presently preferred embodiment of this invention. This seed cleaner 10 includes a rigid frame 20 which is supported at each end by a respective supporting leg 22,24. The first supporting leg 22 is pivotably mounted to an axle 27 which supports a pair of wheels 26. A generally horizontal brace 28 interconnects the first and second supporting legs 22,24 and is pivotably connected to the first support leg 22 by means of the axle 27. As shown in FIG. 3*b*, the supporting leg 24 is pivotably mounted to the frame 20 about axis 25. The first supporting leg 22 terminates in a crossbar 30. A pair of retaining straps 34 are mounted to the underside of the frame 20 to receive the crossbar 30, thereby allowing the crossbar 30 to move along a limited portion of the frame 20.

As best shown in FIGS. 1–3*b*, the seed cleaner 10 includes an upper screened grid 40, a lower screened grid 42, and a ramp 44. The upper and lower screened grids 40, 42 are each rectangular frames. A relatively coarse mesh 54 is secured to the frame of the upper screened grid 40 and a relatively fine mesh 56 is secured to the frame of a lower screened grid 42. As best shown in FIG. 2, clamp plates 58 are used in this embodiment to secure the meshes 54,56 in place.

Figure 3B:
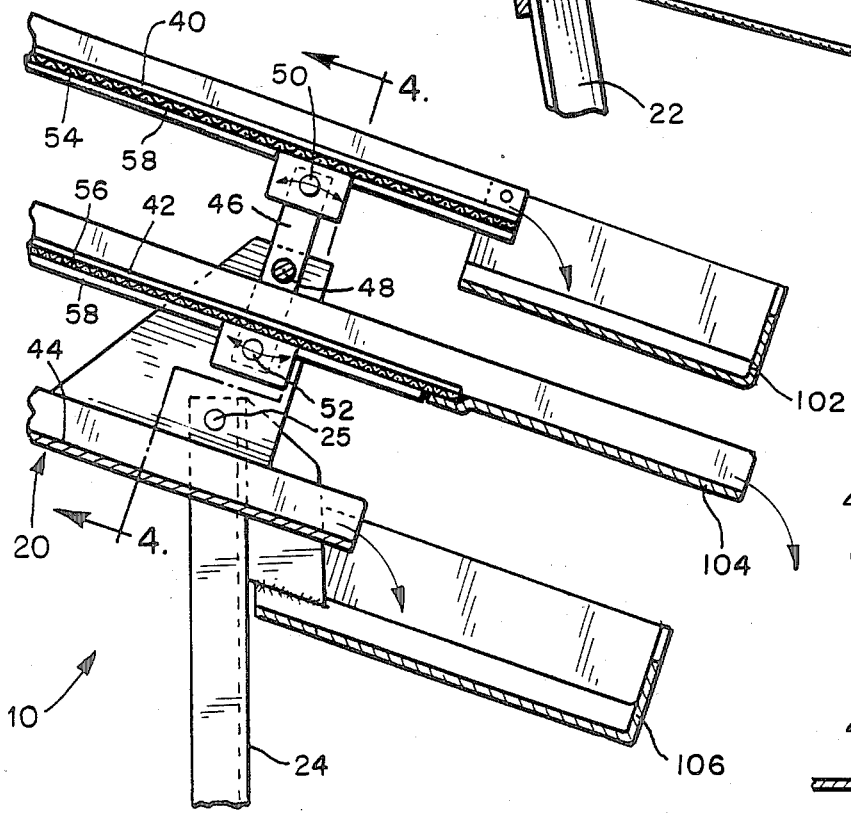
FIG. 3*b* is a longitudinal sectional view of the lower end of the embodiment of FIG. 1, taken along line 3*b*—3*b* of FIG. 2.
Figure 4:
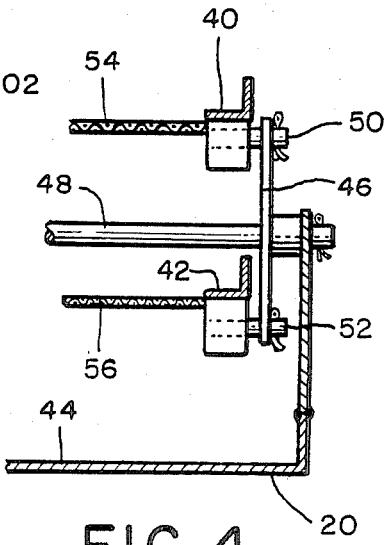
FIG. 4 is a cross-sectional view taken along line 4—4 of FIG. 3*b*.

As shown in FIGS. 3*b* and 4, a pair of toggles 46 are pivotably mounted to the frame 20 by a central pivot axis 48. The upper screened grid 40 is pivotably mounted between the toggles 46 at an upper pivot axis 50, and the lower screened grid 42 is pivotably mounted to the toggles 46 at a lower pivot axis 52. The upper and lower screened grids 40,42 and the ramp 44 extend generally parallel to one another, and the upper and lower screened grids 40,42 are free to pivot about their lower ends.

As best shown in FIGS. 2 and 3*a*, an electric motor 60 is mounted to the frame 20. A drive pulley 62 is rotated by the motor 60, and the drive pulley 62 is drivingly coupled to a second pulley 64 by a V-belt 66. The second pulley 64 is mounted for rotation on one of two spaced, parallel support plates 84 which are rigidly secured to the frame 20. The second pulley 64 is mounted to rotate with an upper crankshaft 68 which is mounted for rotation between the support plates 84. The seed cleaner 10 also includes a lower crankshaft 70 which extends generally parallel to the upper crankshaft 68 between the two support plates 84. Each of the crankshafts 68,70 defines a pair of end shafts 72 and a central offset shaft 74. The end shafts 72 are each supported by suitable bearings in the support plates 84. The offset shaft 74 of the upper crankshaft 68 is rotatably coupled to the upper screened grid 40 by means of a pair of bearing blocks 76. Similarly, the offset shaft 74 of the lower crankshaft 70 is rotatably coupled to the lower screened grid 42 by means of a pair of bearing blocks 76. One of the end shafts 72 of each of the crankshafts 68,70 serves to mount a respective sprocket 80, and a chain 82 interconnects the two sprockets 80. The sprockets 80 and the chain 82 cooperate to ensure that the lower crankshaft 70 rotates in phase with and at the same rotational rate as the upper crankshaft 68. As best shown in FIG. 2, in this preferred embodiment the upper crankshaft 68 is 180 degrees out of phase with respect to the lower crankshaft 70.

A winch 90 is mounted to the underside of the frame 20 and includes a cable 92 which is secured to the leg 22. The winch 90 also includes a manually operated handle 94 which can be used to shorten or extend the effective length of the cable 92. Thus, the winch 90 can be used to change the position of the support leg 22 with respect to the frame 20 in order to adjust the tilt angle of the screened grids 40,42.

A hopper 100 is mounted to the upper end of the upper screened grid 40. The lower end of the upper screened grid 40 is aligned with an upper chute 102 which directs material exiting from the upper screened grid 40 to the side. The lower screened grid 42 is aligned with a center chute 104 which directs material exiting from the lower screened grid 42 axially, at right angles to the direction of discharge of the upper chute 102. The ramp 44 aligns with a lower chute 106 which directs material exiting the ramp 44 in the same direction as that of the upper chute 102.

Merely by way of illustration, the following details are provided in order better to define the presently preferred embodiment of this invention. It should be clearly understood, however, that these details are intended only by way of illustration. In this embodiment the motor 60 is a one half horsepower electric motor which rotates at 725 RPM. The drive pulley 62 is two inches in diameter and the drive pulley 64 is fifteen inches in diameter. In this embodiment, the offset shafts 74 are offset by three quarters of an inch from the end shafts 72, such that the total amplitude of oscillation of the upper and lower screened grids 40,42 is one and one half inch in each case. In this embodiment, the relatively coarse mesh 54 is formed of 19 gauge wire which defines five mesh squares per linear inch in each dimension. Similarly, in this embodiment the mesh 56 is formed of 20 gauge wire and defines eight mesh squares per linear inch in each dimension. These meshes have been found suitable in cleaning wheat. Preferably, the meshes 54,56 are formed of a galvanized steel or the like to reduce corrosion problems.

Having described the structure of the seed cleaner 10, its operation can now be discussed. During setup, the winch 90 is used to adjust the tilt angle of the seed cleaner 10 to the desired value. In general, a steeper tilt angle will increase the capacity of the seed cleaner 10 but reduce the degree to which the seed is cleaned. The winch 90 should be used to choose an appropriate tilt angle for the required capacity and degree of cleaning. The motor 60 is then used to oscillate the upper and lower screened grids 40,42. Because the upper and lower crankshafts 60,70 are 180 degrees out of phase, the screened grids 40,42 move in opposition to one another, thereby minimizing the load applied to the motor 60. Furthermore, since the screened grids 40,42 move in opposition, the overall shaking and vibration of the seed cleaner 10 is also minimized.

Seed to be cleaned is dropped onto the upper screened grid 40 via the hopper 100. The upper screened grid 40 is sized to retain large contaminants such as stalks and the like, and the material retained by the upper screened grid 40 is discharged to the side via the upper chute 102. Smaller material falls through the upper screened grid 40 onto the lower screened grid 42. Preferably, the lower screened grid 42 is provided with a mesh 56 sized to retain the desired seed, which moves downwardly across the mesh 56 and is discharged axially via the center chute 104. Fine contaminants, such as cracked seeds, chaff and the like, pass through the lower screened grid 42 and are carried downwardly on the ramp 44 to be discharged to the side via the lower chute 106. The side panels 108 are mounted to the lower screen grid 42 by fastening means 41 to oscillate therewith and positioned to prevent material from falling off the sides of the screened grids 40,42 and additionally minimize the danger to operators.

From the foregoing, it should be apparent that a simple, reliable and effective seed cleaner has been disclosed which can be used to separate seed from both large and small contaminants rapidly and automatically.

Of course, it should be understood that a range of variations can be made to the preferred embodiment described above. It is therefore intended that the foregoing detailed description be regarded as illustrative rather than limiting, and that it be understood that it is the following claims, including all equivalents, which are intended to define the scope of this invention.

I claim:

1. A seed cleaning device comprising:

a frame defining first and second ends;

a first support leg mounted to the first end to support the first end at a lower level;

a second support leg slideably mounted to the second end to support the second end at a higher level;

an axle which supports a wheel;

a generally horizontal brace extending between the first and second support legs and pivotaly connected to the second support leg by means of the axle;

a winch mounted to the frame and comprising a cable secured to the second support leg, said winch operative to adjust the position of the second support leg with respect to the frame and therefore the elevation of the second end of the frame;

a motor mounted to the frame;

a first crankshaft rotatably mounted to the second end of the frame;

a second crankshaft rotatably mounted to the second end of the frame, parallel to the first crankshaft;

means for rotating the first crankshaft;

means for coupling the second crankshaft to the first crankshaft such that the second crankshaft rotates out of phase with the first crankshaft;

a first screened grid pivotably mounted to the frame near the first end and coupled to the first crankshaft such that rotation of the first crankshaft causes the first screened grid to oscillate;

a second screened grid pivotably mounted to the frame near the second end and coupled to the second crankshaft such that rotation of the second crankshaft causes the second screened grid to oscillate; said second screened grid vertically aligned with and generally parallel to said first screened grid;

a ramp mounted to the frame under and generally parallel to the first and second screened grids to collect material which has passed through the first and second screened grids; and a pair of side panels mounted to one of the screened grids to oscillate therewith and positioned to prevent material from falling off the screened grids and to reduce danger to operators.

2. The invention of claim 1 wherein the upper one of the first and second screened grids defines a coarser grid than the lower one of the first and second screened grids.

3. The invention of claim 2 further comprising:

a first chute positioned to direct material exiting from the upper screened grid in a first direction;

a second chute positioned to direct material exiting from the lower screened grid in a second direction; and a third chute positioned to direct material exiting from the ramp in the first direction.

* * * * *